US008371476B2

(12) United States Patent
Weissbrod

(10) Patent No.: US 8,371,476 B2
(45) Date of Patent: Feb. 12, 2013

(54) BULK BAG WITH GATE VALVE ASSEMBLY

(75) Inventor: Paul A. Weissbrod, South Euclid, OH (US)

(73) Assignee: Lincoln Global, Inc., Cleveland, OH (US)

( * ) Notice: Subject to any disclaimer, the term of this patent is extended or adjusted under 35 U.S.C. 154(b) by 376 days.

(21) Appl. No.: 12/717,336

(22) Filed: Mar. 4, 2010

(65) Prior Publication Data

US 2011/0101040 A1 May 5, 2011

Related U.S. Application Data

(60) Provisional application No. 61/257,287, filed on Nov. 2, 2009.

(51) Int. Cl.
*B65D 35/56* (2006.01)

(52) U.S. Cl. ..... 222/105; 222/561; 222/181.2

(58) Field of Classification Search ..... 222/559, 222/522, 561, 105, 502, 181.2, 254.9, 180; 383/12

See application file for complete search history.

(56) References Cited

U.S. PATENT DOCUMENTS

| | | | | |
|---|---|---|---|---|
| 2,387,640 A | | 10/1945 | Bouchelle | |
| 3,662,922 A | * | 5/1972 | Gesior | 222/46 |
| 4,270,677 A | | 6/1981 | Schmidt | |
| 4,376,501 A | * | 3/1983 | Hafner et al. | 222/600 |
| 4,449,649 A | * | 5/1984 | Flannigan | 222/181.3 |
| 4,856,681 A | * | 8/1989 | Murray | 222/158 |
| 5,396,998 A | | 3/1995 | Chaisson | |
| 5,697,535 A | | 12/1997 | Coleman | |
| 5,730,333 A | * | 3/1998 | Baluk et al. | 222/181.3 |
| 6,439,442 B1 | * | 8/2002 | Markert et al. | 222/547 |
| 6,857,560 B2 | | 2/2005 | Kutner | |
| 2002/0175452 A1 | | 11/2002 | Kawarada | |

FOREIGN PATENT DOCUMENTS

| | | |
|---|---|---|
| CA | 1201271 | 3/1986 |
| EP | 0084942 A1 | 8/1983 |
| EP | 0374773 A1 | 6/1990 |
| FR | 1448303 | 6/1966 |
| FR | 2802189 A1 | 6/2001 |
| GB | 2039842 A | 8/1980 |
| WO | 9733712 | 9/1997 |

OTHER PUBLICATIONS

Bag, as shown on two (2) sheets of engineering drawings attached hereto as Exhibit A. Admitted prior art.
Slide Gate, as shown on photograph attached hereto as Exhibit B. Admitted prior art.
Slide Gate in association with portion of Bag, as generally shown in four (4) CAD drawings attached hereto on two (2) pages as Exhibit C. Admitted prior art.
International Search Report and the Written Opinion, International Application No. PCT/IB2010/002796, mailed on Feb. 7, 2011, 11 pages.
Statutory Invention Registration (SIR) No: H893. Publication Date: Mar. 5, 1991. Inventors: Davidson, et al.

* cited by examiner

*Primary Examiner* — Kevin P Shaver
*Assistant Examiner* — Christopher Bahr
(74) *Attorney, Agent, or Firm* — Ulmer & Berne LLP

(57) ABSTRACT

A bulk bag includes a shell and a gate valve assembly and is configured to retain a material. The gate valve assembly includes a gate which is slidable to selectively prevent and facilitate variation of rate of dispensation of material from the bulk bag and, more particularly, through an aperture defined by the shell of the bulk bag. The gate valve assembly has a configuration which, during movement of the gate to restrict dispensation of material through the aperture in the shell, renders the gate unlikely to snag with other portions of the bulk bag such as, for example, portions of the shell which define the aperture. Methods are also provided.

18 Claims, 7 Drawing Sheets

BULK BAG WITH GATE VALVE ASSEMBLY

REFERENCE TO RELATED APPLICATION

The present application claims priority of U.S. provisional application Ser. No. 61/257,287 filed Nov. 2, 2009, and hereby incorporates the same provisional application by reference herein in its entirety.

TECHNICAL FIELD

The present invention relates to bulk bags having a gate valve assembly.

BACKGROUND

Conventional bulk bags are used to facilitate transportation, storage and dispensation of various bulk materials such as, for example, powdered or granular flux material for use in a submerged are welding process or other welding processes.

SUMMARY

In accordance with an embodiment, a bulk bag is configured for storing and dispensing bulk material. The bulk bag comprises shell means, lifting means, and valve means. The shell means defines a storage chamber and an aperture in communication with the storage chamber. The storage chamber is configured to retain bulk material. The lifting means facilitates lifting of the bulk bag. The valve means is slidable with respect to the aperture and defines a first opening having a generally triangular shape. The valve means is configured to selectively facilitate retention of bulk material within the storage chamber. The valve means is also configured to selectively facilitate controlled dispensation of bulk material from the storage chamber and sequentially through the aperture and the first opening.

BRIEF DESCRIPTION OF THE DRAWINGS

It is believed that certain embodiments will be better understood from the following description taken in conjunction with the accompanying drawings in which.

DETAILED DESCRIPTION

Figure 1:
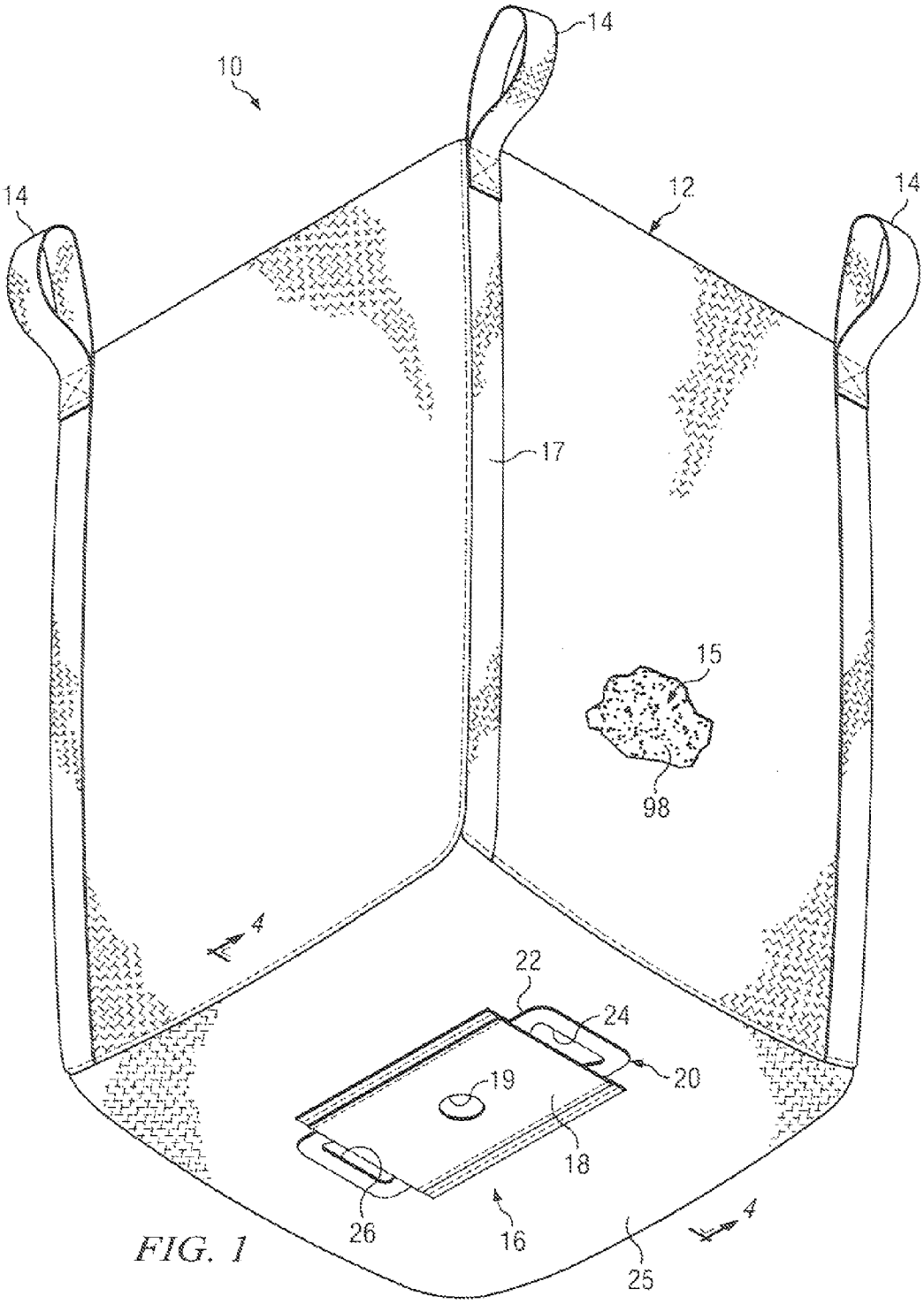
FIG. 1 is a bottom side perspective view depicting a bulk bag having a gate valve assembly in accordance with one embodiment, wherein a portion of a shell of the bulk bag is broken away to depict bulk material within a storage chamber defined by the shell, and wherein a gate of the gate valve assembly is in a first position to prevent the bulk material from dispensing from the bulk bag.

Selected embodiments are hereinafter described in detail in connection with the views and examples of FIGS. 1-9 and 10A-10D. A bulk bag can be used to facilitate transportation, storage and dispensation of various bulk materials such as, for example, powdered or granular flux material for use in a submerged are welding process or other welding processes. For example, a bulk bag 10 in accordance with one embodiment is shown and described herein in connection with FIGS. 1-9. The bulk bag 10 is shown to comprise a shell 12 which defines a storage chamber (shown generally as "15" in FIG. 1). The storage chamber 15 is shown in FIG. 1 to retain a bulk material 98 such as can be, for example, powdered or granular flux material for use in a submerged are welding process or other welding processes. The shell 12 can be flexible and can comprise a material such as cloth, plastic sheeting, and/or any of a variety of other suitable materials which are of sufficient density and strength to retain the bulk material 98 within the storage chamber 15.

The shell 12 can include one or more support straps and/or other reinforcement features (e.g., 17 in FIG. 1) that can provide structural support to the shell 12 and/or can facilitate maintenance of the shell 12 in a particular shape. It will be appreciated that a shell of a bulk bag can be provided in any of a variety of other suitable shapes and sizes, and can be provided with any of a variety of additional or alternative reinforcement features. The shell 12 can be sewn or stitched together and/or can involve adhesives, rivets, snaps, heat seals, and/or any of a variety of other suitable features or mechanical fastening arrangements.

The bulk bag 10 can also include lifting members which are attached to the shell 12 to facilitate lifting of the bulk bag 10. for example, the bulk bag 10 is shown to Include to comprise a plurality of loops 14 which can be used by a crane or hoist to facilitate lifting of the bulk bag 10 for transportation or to facilitate dispensation of the bulk material 98, such as flux, from the bulk bag 10. it will be appreciated that lifting members of a bulk bag can alternatively comprise hooks, apertures, or any of a variety of other suitable features.

The bulk bag 10 can also include a gate valve assembly as generally shown at 16. A bottom wall 25 of the shell 12 is shown to define an aperture 13 (see FIGS. 4 and 6-9). The aperture 13 can be provided in communication with the storage chamber 15. The bulk material 98 within the storage chamber 15 can selectively dispense through the aperture 13 as controlled by the gate valve assembly 16. More particularly, as described in further detail below, the gate valve assembly 16 can selectively facilitate retention of the bulk material 98 within the storage chamber 15, and provide controlled dispensation of the bulk material 98 from the storage chamber 15 and through the aperture 13.

The gate valve assembly 16 can include a retention member 18 and a gate 20. The retention member 18 can be fixedly attached to the bottom wall 25 of the shell 12 such as through sewing, adhesives, rivets, snaps, heat seals, and/or any of a variety of other suitable features or mechanical fastening arrangements. In one embodiment, the retention member 18 can comprise a material similar to that of the shell 12. For example, the shell 12 and the retention member 18 can be formed from cloth, plastic sheeting, or some other suitable flexible material. In another embodiment, a retention member of a bulk bag can comprise a different material than the material(s) which defines a shell of the bulk bag.

Figure 3:
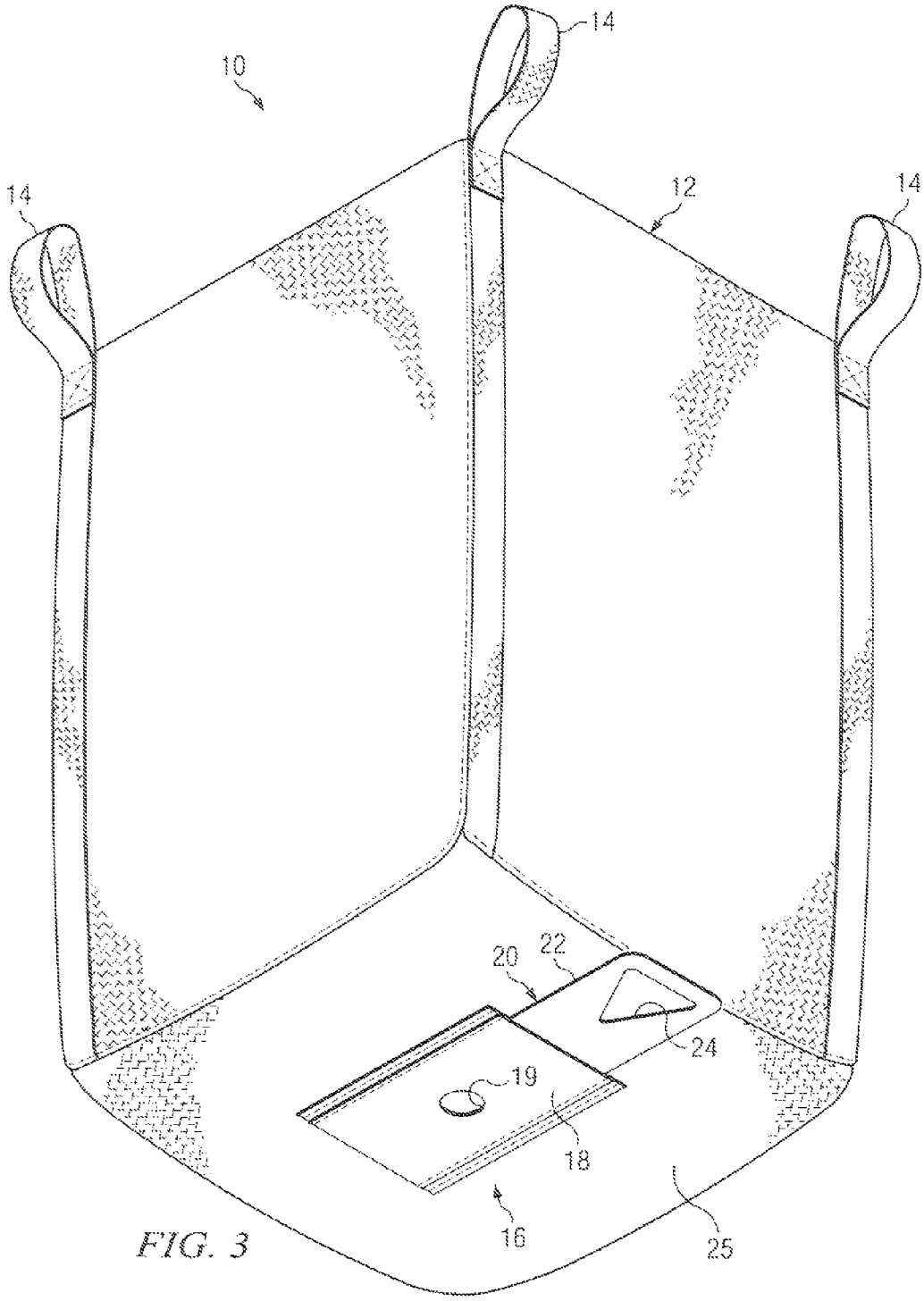
FIG. 3 is a bottom side perspective view depicting the bulk bag of FIG. 1, wherein the gate is in a third position to facilitate flow of the bulk material from within the storage chamber at a relatively high rate.
Figure 4:
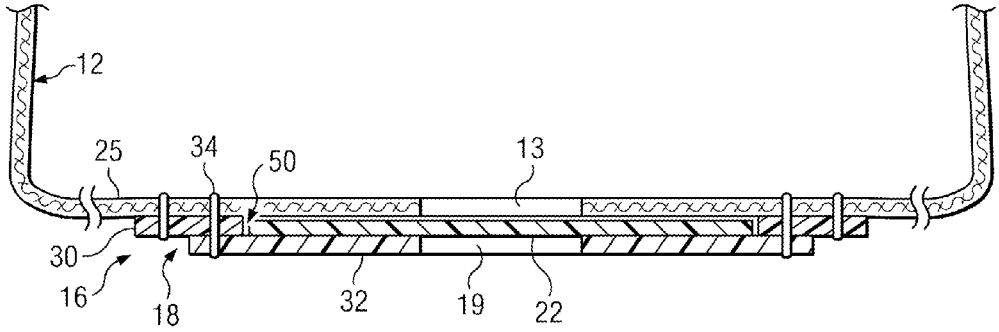
FIG. 4 is a cross-sectional view taken along section lines 4-4 in FIG. 1.
Figure 5:
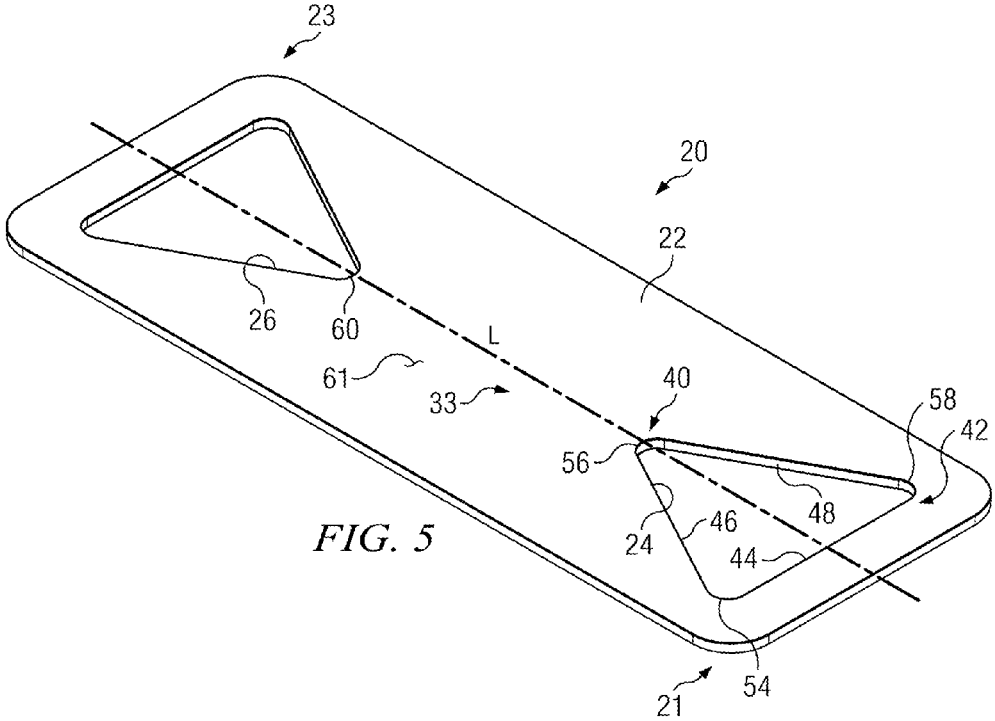
FIG. 5 is a perspective view depicting the gate apart from the remaining components of the bulk bag of FIG. 1.
Figure 6:
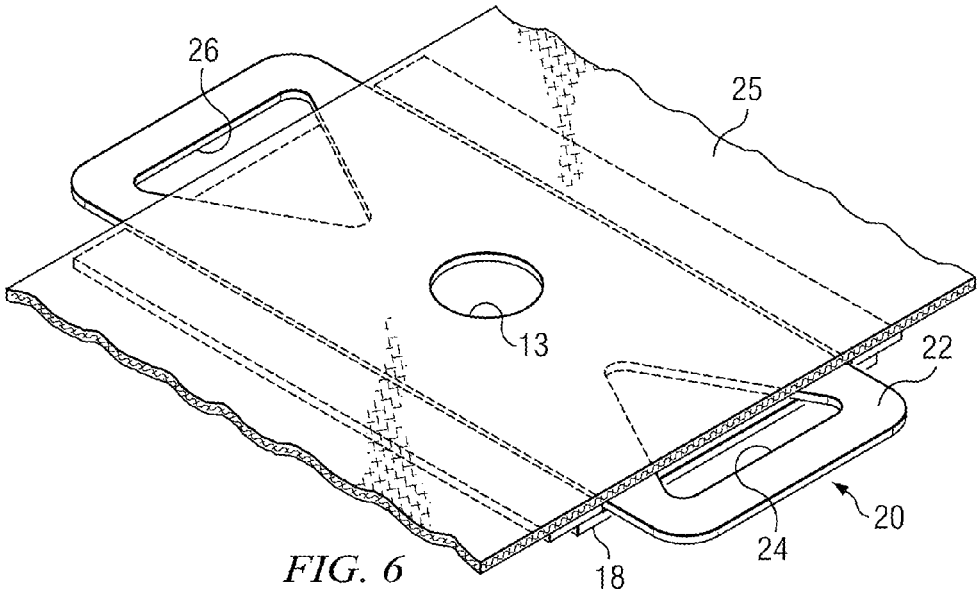
FIG. 6 is a top perspective fragmentary view depicting a portion of the bulk bag of FIG. 1, wherein the gate is in the first position, and wherein certain hidden lines are shown in phantom.

When the retention member 18 is attached to the shell 12 as shown in FIGS. 1-4 and 6-9, the retention member 18 can cooperate with the shell 12 to define a channel (50 in FIG. 5). At least a portion of the gate 20 can be slidably received within the channel 50, as described in further detail below. The retention member 18 can define an aperture 19 which substantially aligns with the aperture 13 in the shell 12 and, in certain positions of the gate 20, communicates with the aperture 13 to facilitate dispensation of the bulk material 98 from the storage chamber 15. In one embodiment, the apertures 13 and 19 can be similar in size and shape.

In one embodiment, as shown in FIG. 4, the retention member 18 can include a spacer portion 30 and a wall portion 32 which are each attached to the shell 12 with thread (e.g., 34). Each of the spacer portion 30, the wall portion 32, and the shell 12 can cooperate to define the channel 50 for slidably receiving the gate 20. It will be appreciated that, in alternative embodiments (e.g., as generally shown in FIGS. 6-9), the retention member 18 can include a spacer portion and a wall portion which are formed as a unitary structure. It will be appreciated that a retention member can be provided and attached to a shell in any of a variety of suitable configurations. In another embodiment, a retention member can be formed as a unitary structure with one or more portions of a shell.

The gate 20 can be slidable relative to the retention member 18 and the opening 13 between one or more closed positions and one or more opened positions. In the closed position, a blocking portion 33 (FIG. 5) of the gate 20 can prevent dispensation of the bulk material 98 from the storage chamber 15 through the aperture 13 in the shell 12. In an opened position, the gate 20 can facilitate flow or dispensation of the bulk material 98 sequentially through the aperture 13 in the shell 12, an opening (e.g., 24 or 26) in the gate 20, and the aperture 19 in the retention member 18. In one embodiment, the gate 20 can be slidable with respect to the retention member 18 and the aperture 13 to facilitate an infinitely variable rate of flow or dispensation of the bulk material 98 from the storage chamber 15. However, in another embodiment, a gate can be slidable among a plurality of preset positions or stops, each of which corresponds to a particular flow rate. Depending upon the position of the gate 20 relative to the retention member 18 and the shell 12, the bulk material 98 within the storage chamber 15 can be prevented from being dispensed from the storage chamber 15, or can be dispensed or poured from the storage chamber 15 at any of a variety of selectable rates of dispensation.

The gate 20 can be formed from plastic, wood, metal, and/or any of a variety of other suitable materials. In one embodiment, such as shown in FIG. 5, the gate 20 can he formed as a unitary and substantially rigid structure. It will be appreciated, however, that a gate can be formed in any of a variety of other suitable configurations. The gate 20 is shown in FIG. 5 to comprise a body 22 in the form of a generally rectangularly-shaped plate and which extends along a longitudinal axis "L" between respective ends 21 and 23. The longitudinal axis "L" can centrally bisect the gate 20 such that the gate 20 is generally symmetrical on opposite sides of the longitudinal axis "L", as shown in FIG. 5.

The body 22 is shown to define respective openings 24 and 26 adjacent to respective ends 21 and 23 of the body 22. Each of the openings 24 and 26 is shown to have a generally triangular shape. More particularly, in defining the opening 24, the body 22 is shown to include edges 44, 46, and 48 which cooperate to define a generally triangular shape having vertices 54, 56, and 58. The edge 44 is shown to be generally straight and perpendicular to the longitudinal axis "L". The edge 44 is also shown to be adjacent to the end 21 of the body 22. The edges 46 and 48 are shown to be generally straight and to extend from opposite ends of the edge 44 (located at vertices 54 and 58), and at opposite inclines relative to the longitudinal axis "L", for meeting at the vertex 56. The vertex 56 is shown to be located upon the longitudinal axis "L" between the edge 44 and the end 23 of the body 22. The opening 24 is shown to extend from an inside end 40 to an outside end 42. The inside end 40 of the opening 24 can be defined by the vertex 56, while the outside end 42 can be defined by the edge 44. The body 22 is shown to define the opening 26 to have a configuration similar to that of the opening 24, such that the apertures 24 and 26 are similar in size and shape, but such that the opening 26 is in a mirrored position in the body 22 relative to the opening 24. More particularly, the opening 26 is shown to have a generally triangular shape similar to that of the opening 24 and including a vertex 60. In other embodiments, a gate can be provided with only a single generally triangularly-shaped opening, or with more than two generally triangularly-shaped openings, and in either circumstance possibly in addition to openings having other shapes.

The vertices 56, 60 can be disposed upon the longitudinal axis "L" and the blocking portion 33 of the gate 20 can extend between the vertices 56, 60. The blocking portion 33 can include an upper surface 61 that extends continuously between the vertices 56, 60 (e.g., along the longitudinal axis) such that the blocking portion 33 is devoid of discontinuities that would permit passage of any material therethrough.

Figure 10B:
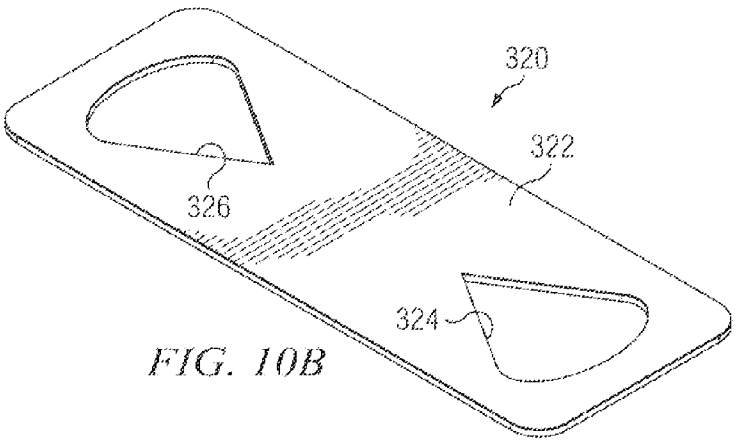
FIG. 10B is a perspective view depicting a gate in accordance with a third embodiment.
Figure 10A:
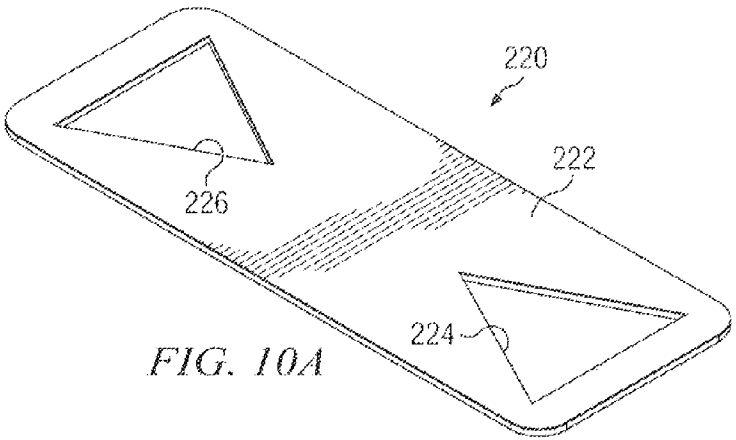
FIG. 10A is a perspective view depicting a gate in accordance with a second embodiment.
Figure 10D:
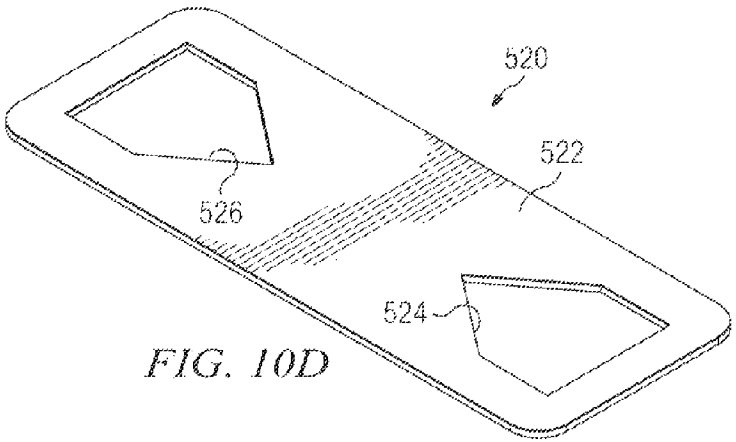
FIG. 10D is a perspective view depicting a gate in accordance with a fifth embodiment.
Figure 10C:
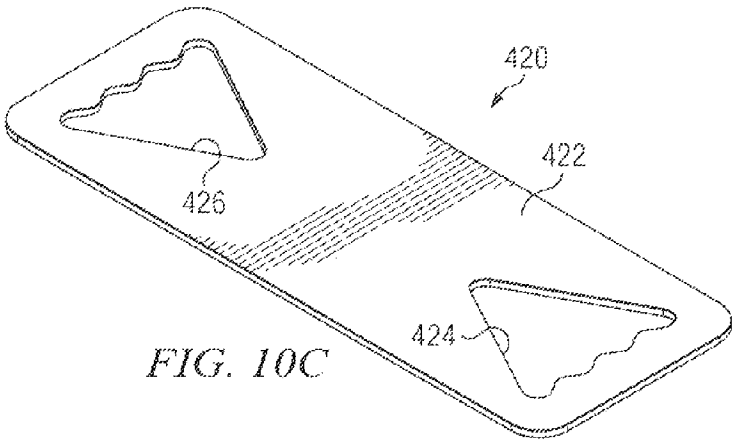
FIG. 10C is a perspective view depicting a gate in accordance with a fourth embodiment.

It will be appreciated that generally triangularly-shaped openings in a body of a gate can be provided in any of a variety of other suitable configurations, such as shown in FIGS. 10A-10D. FIG. 10A illustrates a gate 220 having a body 222 which defines openings 224 and 226; FIG. 10B illustrates a gate 320 having a body 322 which defines openings 324 and 326; FIG. 10C illustrates a gate 420 having a body 422 which defines openings 424 and 426; and FIG. 10D illustrates a gate 520 having a body 522 which defines openings 524 and 526. It will also be appreciated that an outer edge which partially defines a generally triangularly-shaped opening in a gate might not be generally straight (like edge 44 in FIG. 5), but might rather be curved or otherwise shaped to facilitate comfortable grasping of the gate by a hand of an operator, such as shown in FIGS. 10B and 10C. It will further be appreciated that one or more vertices defining a generally triangularly-shaped opening in a gate might not be rounded or curved (like vertices 54, 56 and 58 in FIG. 5), but might rather be pointed, such as shown in FIG. 10A. It will additionally be appreciated that a generally triangularly-shaped opening might not be defined by only three edges (like edges 44, 46, and 48 in FIG. 5), but might rather be defined by more than three edges, such as shown in FIG. 10D.

Figure 2:
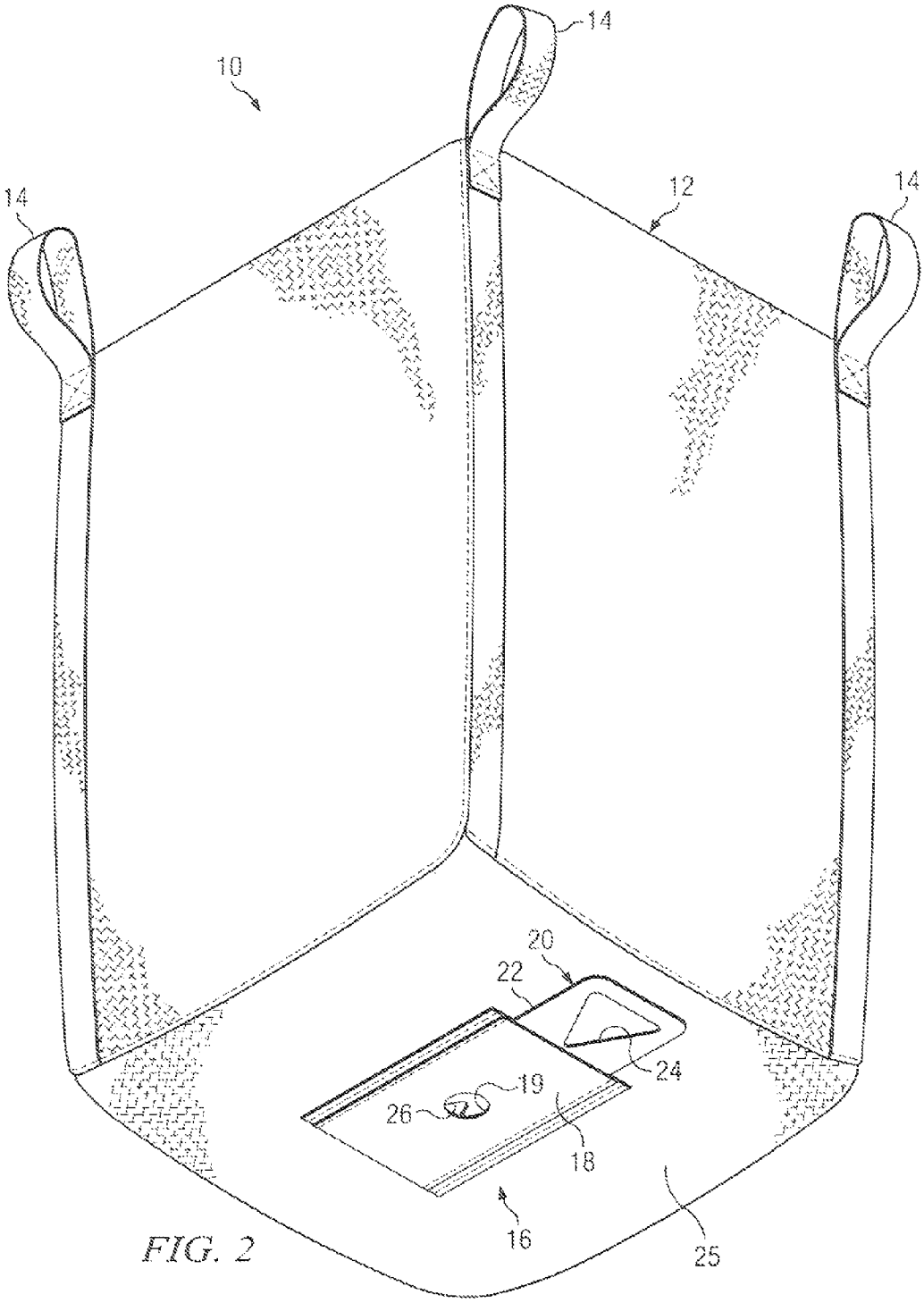
FIG. 2 is a bottom side perspective view depicting the bulk bag of FIG. 1, wherein the gate is in a second position to facilitate flow of the bulk material from within the storage chamber at a relatively low rate.
Figure 7:
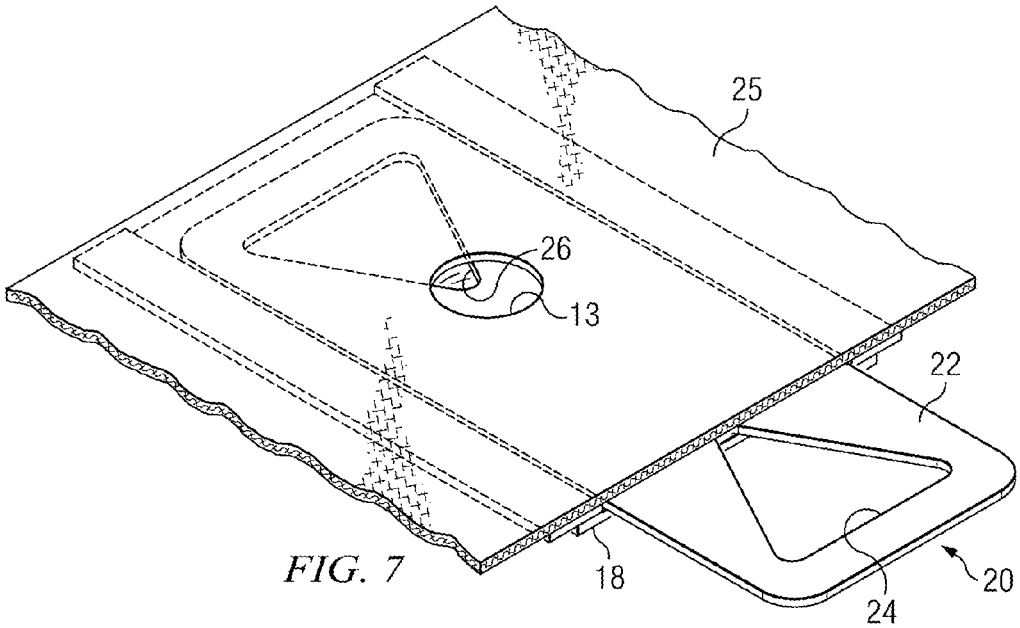
FIG. 7 is a top perspective fragmentary view depicting a portion of the bulk bag of FIG. 1, wherein the gate is in the second position, and wherein certain hidden lines are shown in phantom.

In order to facilitate sliding of the gate 20 with respect to the retention member 18 and the aperture 13, an operator can push or pull on the gate 20 by grasping a portion of the gate 20 which defines one of the openings 24 and 26. The gate 20 is shown in a first or closed position in each of FIGS. 1 and 6. In the closed position, the gate 20 prevents dispensation of the bulk material 98 from the storage chamber 15 through the aperture 13 in the shell 12. When an operator desires to dispense the bulk material 98 from the bulk bag 10, the operator can attach a crane to loops 14 of the bulk bag 10 and can use the crane to lift the bulk bag 10. An operator can then grasp the gate 20, such as by placing his or her fingers through the opening 24 in the gate 20, and can partially withdraw the gate 20 from the channel 50, resulting in movement of the gate 20 to a second position as generally shown in FIGS. 2 and 7. In this second position, a portion of the opening 26 in the gate 20 can align with the aperture 13 in the shell 12 and the aperture 19 in the retention member 18 such that the bulk material 98 from within the storage chamber 15 can be dispensed through the aperture 13, the opening 26, and the aperture 19. In this position, it can be seen that only a small portion of the opening 26 aligns with the apertures 13 and 19, and that a portion of the body 22 partially obstructs the apertures 13 and 19, thus allowing the bulk material 98 to flow from within the storage chamber 15 at a relatively low and controlled rate. It will be appreciated that, when sliding the gate 20 to facilitate initial dispensation of the bulk material 98 from the storage chamber 15, a vertex (e.g., similar to 56 of opening 24) of the opening 26 is the first portion of the opening 26 to align with the apertures 13 and 19.

Figure 8:
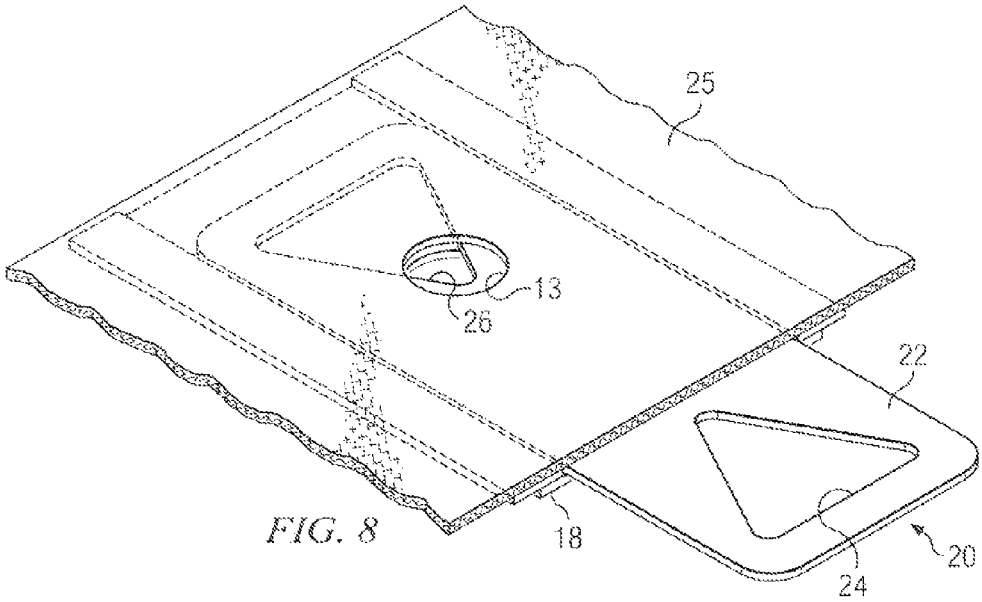
FIG. 8 is a top perspective fragmentary view depicting a portion of the bulk bag of FIG. 1, wherein the gate is in a fourth position, and wherein certain hidden lines are shown in phantom.
Figure 9:
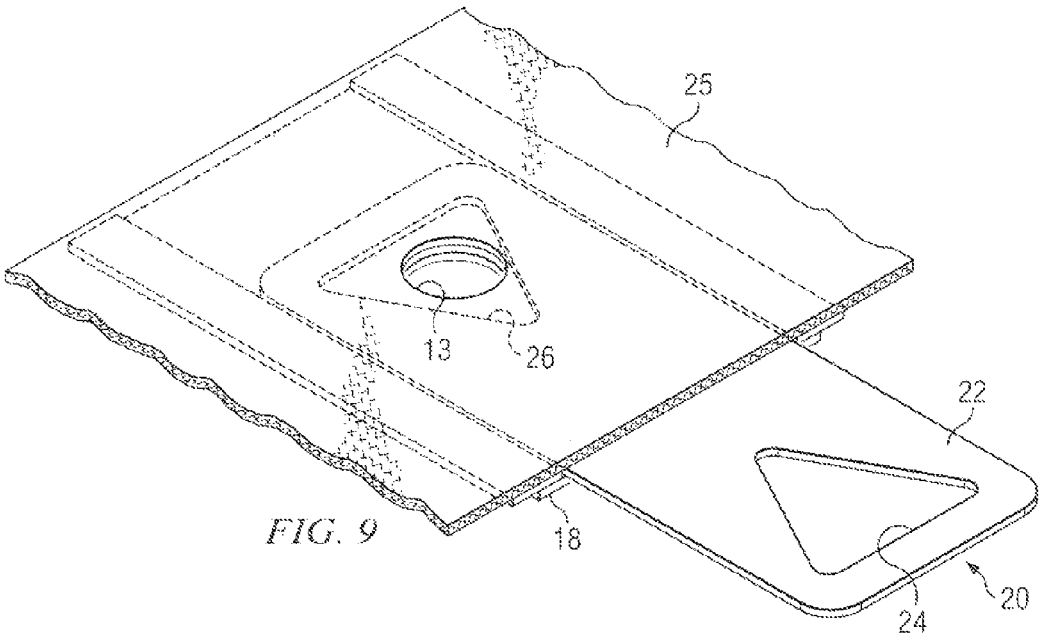
FIG. 9 is a top perspective fragmentary view depicting a portion of the bulk bag of FIG. 1, wherein the gate is in the third position, and wherein certain hidden lines are shown in phantom.

Upon further withdraw of the gate 20 from the channel 50, as generally shown in FIG. 8, a larger portion of the opening 26 aligns with the apertures 13 and 19, such that a smaller portion of the body 22 partially obstructs the apertures 13 and 19, thus allowing the bulk material 98 to flow from within the storage chamber 15 at a relatively higher rate than would be achieved in the configuration of FIG. 7. Upon still further withdraw of the gate 20 from the channel 50, as generally shown in FIGS. 3 and 9, a still larger portion of the opening 26 can align with the apertures 13 and 19, thus allowing the bulk material 98 to flow from within the storage chamber 15 at a still relatively higher rate than would be achieved in the configuration of FIG. 8, or at a maximum possible rate. In one embodiment, the opening 26 can be sized such that no portion of the body 22 obstructs any portion of either of the apertures 13 and 19 when the body 22 facilitates dispensation at a maximum possible rate (e.g., a portion of the opening 26 is larger than each of the apertures 13 and 19, as shown in FIG. 9). In an alternative embodiment, the opening 26 can be sized such that, even when the body 22 facilitates dispensation at a maximum possible rate, a portion of the body 22 can obstruct respective portions of the apertures 13 and 19 (e.g., no portion of the opening 26 is larger than either of the apertures 13 and 19).

Accordingly, by sliding the gate 20 into and out from the channel 50, it will be appreciated that an operator can selectively adjust or stop the rate of flow of the bulk material 98 from the storage chamber 15 in a controlled manner. In contrast to grasping the body 22 at the opening 24 as described above to facilitate movement of the gate 20 and selective dispensation of the bulk material 98 through the opening 26 in the gate 20 and from the storage chamber 15, an operator can alternatively grasp the body 22 at the opening 26 to facilitate movement of the gate 20 and selective dispensation of the bulk material 98 through the opening 24 in the gate 20 and from the storage chamber 15. In this configuration, it will be appreciated that each of the openings 24 and 26 in the gate 20 can selectively and alternatively serve as a handle and a regulator to facilitate dispensation of the bulk material 98 from the storage chamber 15.

It will be appreciated that the generally triangular shape of the openings 24 and 26 in the gate 20 can facilitate convenient, efficient, and effective selective dispensation of the bulk material 98 from the bulk bag 20. In the example described above with reference to FIGS. 1-9, the generally triangular shape of the openings 24 and 26 facilitate a progressively increasing dispensation of the bulk material 98 from the storage chamber 15 as the gate 20 is further withdrawn from the channel 50. Likewise, the generally triangular shape of the openings 24 and 26 facilitates a progressively decreasing dispensation of the bulk material 98 from the storage chamber 15 as the gate 20 is returned into the channel 50. Accordingly, due to the generally triangular shape of the openings 24 and 26, it will be appreciated that linear sliding movement of the gate 20 can facilitate non-linear (e.g., exponential) increase or decrease in flow of the bulk material 98 from the storage chamber 15. When the gate 20 is in a slightly withdrawn position as shown in FIGS. 2 and 7, the portion of the opening 26 (i.e., adjacent to its inner vertex similar to vertex 56 of opening 24) allowing the bulk material 98 to pass through the apertures 13 and 19 can be relatively small as compared to the size of the apertures 13 and 19. Therefore, from that position, further insertion of the gate 20 into the channel 50 to completely block the dispensation of the bulk material 98 from the storage chamber 15 (i.e., to the position shown in FIGS. 1 and 6) can require only a small amount of force upon the gate 20 by an operator, and any likelihood of jamming resulting from flowing of the bulk material 98 or snagging of the shell 12 or retention member 18 with the edges (e.g., like edges 44, 46, and 48 which define the opening 24) of the gate 20 can be minimized.

The foregoing description of embodiments and examples of the invention has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate the principles of the invention and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. A bulk bag for storing and dispensing bulk material, the bulk bag comprising:

a flexible shell defining a storage chamber and a first aperture, the storage chamber configured to retain bulk material, the first aperture in communication with the storage chamber;

a plurality of lifting members attached to the flexible shell; and a gate valve assembly comprising:

a retention member fixedly attached to the flexible shell, defining a second aperture and at least partially defining a channel, wherein the second aperture is substantially aligned with the first aperture; and a gate extending along a longitudinal axis and having first and second openings along the longitudinal axis, the first and second openings each having a generally triangular shape, and the second opening being in a mirrored position relative to the first opening, the gate comprising:

a first end;

a second end;

a first edge;

a second edge;

a third edge;

a fourth edge;

a fifth edge;

a sixth edge; and a blocking portion that includes an upper surface; wherein:

the first, second, and third edges cooperate to at least partially define the first opening;

the first and second edges meet at a first vertex;

the fourth, fifth, and sixth edges cooperate to at least partially define the second opening;

the fourth and fifth edges meet at a second vertex;

the first vertex and the second vertex are disposed upon the longitudinal axis;

the upper surface of the blocking portion extends continuously between the first and second vertices;

at least a portion of the gate is slidably received within the channel; and the gate is slidable relative to the retention member between:

a closed position in which the gate prevents dispensation of bulk material from the storage chamber through the first aperture, and an opened position in which the gate facilitates dispensation of bulk material from the storage chamber sequentially through the first aperture, one of the first and second openings, and the second aperture.

2. The bulk bag of claim 1 wherein:

the longitudinal axis bisects the gate such that the gate is generally symmetrical on opposite sides of the longitudinal axis;

the first edge is generally straight;

the second edge is generally straight;

the fourth edge is generally straight;

the fifth edge is generally straight;

the first vertex is at a location between the third edge and the second end; and the second vertex is at a location between the sixth edge and the first end.

3. The bulk bag of claim 2 wherein:

the first edge and the third edge meet at a third vertex;

the second edge and the third edge meet at a fourth vertex;

the fourth edge and the sixth edge meet at a fifth vertex; and the fifth edge and the sixth edge meet at a sixth vertex.

4. The bulk bag of claim 2 wherein the third edge and the sixth edge are generally straight.

5. The bulk bag of claim 1 wherein each of the first and second openings selectively and alternatively serve as a handle and a regulator to facilitate dispensation of bulk material from the storage chamber.

6. The bulk bag of claim 1 wherein the retention member cooperates with the flexible shell to define the channel.

7. The bulk bag of claim 1 wherein the flexible shell is formed from at least one of cloth and plastic sheeting.

8. The bulk bag of claim 1 wherein the gate is formed as a unitary and substantially rigid structure.

9. The bulk bag of claim 1 wherein the gate is slidable with respect to the retention member to facilitate a variable rate of dispensation of bulk material from the storage chamber.

10. The bulk bag of claim 4 wherein the third edge and the sixth edge are not generally straight.

11. A bulk bag for storing and dispensing bulk material, the bulk bag comprising:

a flexible shell defining a storage chamber and a first aperture, and the storage chamber configured to retain bulk material, wherein the first aperture is in communication with the storage chamber and has a first diameter;

lifting means for facilitating lifting of the bulk bag; and a gate valve assembly comprising:

a retention member fixedly attached to the flexible shell, defining a second aperture, and at least partially defining a channel, wherein the second aperture is substantially aligned with the first aperture; and a gate extending along a longitudinal axis and having a first opening and a second opening along the longitudinal axis, the first and second openings each having a generally triangular shape and each defining a first vertex and a second vertex, respectively, and the second opening being in a mirrored position relative to the first opening, the gate comprising a blocking portion that includes an upper surface that extends continuously between the first vertex and the second vertex;

wherein:

the first vertex and the second vertex are disposed upon the longitudinal axis;

at least a portion of the gate is slidably received within the channel; and the gate is slidable relative to the retention member between:

a closed position in which the gate prevents dispensation of bulk material from the storage chamber through the first aperture, and an opened position in which the gate facilitates dispensation of bulk material from the storage chamber sequentially through the first aperture, one of the first and second openings, and the second aperture.

12. The bulk bag of claim 11 wherein the gate further comprises a first end and a second end, the longitudinal axis bisects the gate such that the gate is generally symmetrical on opposite sides of the longitudinal axis, the first vertex is at a location between the second vertex and the second end, and the second vertex is at a location between the first vertex and the first end.

13. The bulk bag of claim 11 wherein the first opening defines a third vertex and a fourth vertex and the second opening defines a fifth vertex and a sixth vertex.

14. The bulk bag of claim 11 wherein each of the first and second openings selectively and alternatively serve as a handle and a regulator to facilitate dispensation of bulk material from the storage chamber.

15. The bulk bag of claim 11 wherein the retention member cooperates with the flexible shell to define the channel.

16. The bulk bag of claim 11 wherein the flexible shell is formed from at least one of cloth and plastic sheeting.

17. The bulk bag of claim 11 wherein the gate is formed as a unitary and substantially rigid structure.

18. The bulk bag of claim 11 wherein the gate is slidable with respect to the retention member to facilitate a variable rate of dispensation of bulk material from the storage chamber.

* * * * *

UNITED STATES PATENT AND TRADEMARK OFFICE

CERTIFICATE OF CORRECTION

PATENT NO. : 8,371,476 B2
APPLICATION NO. : 12/717336
DATED : February 12, 2013
INVENTOR(S) : Weissbrod It is certified that error appears in the above-identified patent and that said Letters Patent is hereby corrected as shown below:

In the Specifications:
Column 1, line 20, change “are” to --arc--;
Column 2, line 29, change “are” to --arc--;
Column 2, line 36, change “are” to --arc--;
Column 2, line 55, change “for” to --For--;
Column 2, line 55, change “Include” to --include--;
Column 2, line 59, change “it” to --It--; and
Column 4, line 1, change “he” to --be--.

Signed and Sealed this
Seventh Day of May, 2013

Teresa Stanek Rea
*Acting Director of the United States Patent and Trademark Office*